US006895993B2

(12) United States Patent
Kobayashi et al.

(10) Patent No.: US 6,895,993 B2
(45) **Date of Patent: *May 24, 2005**

(54) EXPANSION VALVE

(75) Inventors: Kazuto Kobayashi, Tokyo (JP); Masamichi Yano, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 143 days.

This patent is subject to a terminal disclaimer.

(21) Appl. No.: 10/152,821

(22) Filed: May 23, 2002

(65) Prior Publication Data

US 2002/0185178 A1 Dec. 12, 2002

(30) Foreign Application Priority Data

May 29, 2001 (JP) ..... 2001-160245

(51) Int. Cl.[7] ..... F16K 31/365
(52) U.S. Cl. ..... 137/454.6; 137/468; 236/92 B
(58) Field of Search ..... 137/454.6, 468; 236/92 B

(56) References Cited

U.S. PATENT DOCUMENTS

| | | | | |
|---|---|---|---|---|
| 3,738,120 A | * | 6/1973 | Beatenbough | 62/229 |
| 3,785,554 A | | 1/1974 | Proctor | |
| 5,127,237 A | * | 7/1992 | Sendo et al. | 62/225 |
| 5,826,438 A | | 10/1998 | Ohishi et al. | |
| 6,185,959 B1 | * | 2/2001 | Zajac | 62/527 |
| 6,209,793 B1 | * | 4/2001 | Taguchi | 236/92 B |
| 6,626,365 B2 | * | 9/2003 | Kobayashi et al. | 236/92 B |

FOREIGN PATENT DOCUMENTS

| | | |
|---|---|---|
| EP | 0438625 A2 | 7/1991 |
| EP | 0846927 A1 | 6/1998 |
| EP | 0959310 A2 | 11/1999 |
| EP | 1043553 A2 | 10/2000 |
| JP | 08029019 | 2/1996 |
| JP | 08152232 | 6/1996 |
| JP | H08-152232 | 6/1998 |
| JP | H11-351440 | 12/1999 |

OTHER PUBLICATIONS

European Search Report dated Nov. 21, 2003.

* cited by examiner

*Primary Examiner*—Stephen M. Hepperle
(74) *Attorney, Agent, or Firm*—Rader, Fishman & Grauer PLLC

(57) ABSTRACT

An expansion valve 1 comprises a piping member 10 equipped with passages to which refrigerant pipes are connected, and a cassette unit 100, the two members being formed as separate units. The cassette unit 100 comprises a tube member 110 having a flange portion 111, and at the interior of the tube member 110 are fixed a guide member 170, an orifice member 180, and a plate member 166. The pressure of the gas filled in a gas charge chamber 122 defined by a lid 120 and a diaphragm 130 displaces the diaphragm 130, the displacement being transmitted through a stopper member 140 to a shaft member 150. The shaft member 150 is guided by a guide member 170 and controls the valve means 160 inside a valve chamber 161. The cassette unit 100 is inserted to the piping member 10 and fixed to position by a ring 50. Seal members 62, 64, and 66 are equipped to appropriate areas between the cassette unit and the piping member.

7 Claims, 6 Drawing Sheets

EXPANSION VALVE

FIELD OF THE INVENTION

The present invention relates to an expansion valve mounted to a refrigeration cycle of an air conditioner equipped for example in a vehicle.

DESCRIPTION OF THE RELATED ART

For example, Japanese Patent Laid-Open Provisional Publication No. 8-152232 discloses forming separately an expansion valve body and a functional member comprising a diaphragm, and creating an expansion valve by assembling the separately formed functional member to the valve body. Further, a spring is disposed inside a temperature sensing case of the expansion valve, and the distance between the spring and the spring receiver can be adjusted by a screw mechanism. A similar expansion valve is disclosed in Japanese Patent Laid-Open Provisional Publication No. 11-351440.

The above-mentioned expansion valve disclosed in Japanese Patent Laid-Open Provisional Publication No. 8-152232 is equipped with a screw mechanism formed to the mounting portion of the temperature sensing case, and further equipped with another screw mechanism for fixing the whole body of the functional member to the valve body, so the overall structure of the expansion valve becomes rather complicated.

SUMMARY OF THE INVENTION

The present invention aims at providing an expansion valve having a simplified structure, by composing the expansion valve with a piping member and a cassette unit provided with all the functions of the expansion valve.

The expansion valve according to the present invention comprises a piping member including refrigerant passages to which pipes communicated to various equipments of the air conditioner are connected, and a cassette unit inserted to the piping member; the cassette unit comprising a tube member formed integrally with a flange unit; a guide member, an orifice member, and a plate member fixed to the inside of the tube member; a valve means equipped inside a valve chamber defined by said orifice member; a plate member further defining said valve chamber; a spring disposed between the plate member and the valve means for biasing the valve means toward the orifice member; a shaft member for driving the valve means; a lid member welded onto the flange portion; a diaphragm pinched between the lid member and the flange portion and defining a gas charge chamber; and a stopper member for transmitting the displacement of the diaphragm to the shaft member; the expansion valve further comprising a ring for fixing to the piping member the lid member of the cassette unit inserted to the piping member; and a seal member disposed between the outer wall of the cassette unit and the inner wall of the piping member.

Further, the axis line of the refrigerant passage formed to the piping member is designed to correspond to the layout of the pipes.

Moreover, the present expansion valve can include a rubber bush equipped to the exterior of the tube member, and a rubber seal member baked onto the exterior of the tube member.

Even further, the guide member, the orifice member, and the plate member are fixed to the tube member through caulking.

DETAILED DESCRIPTION OF THE PREFERRED EMBODIMENT

Figure 1:
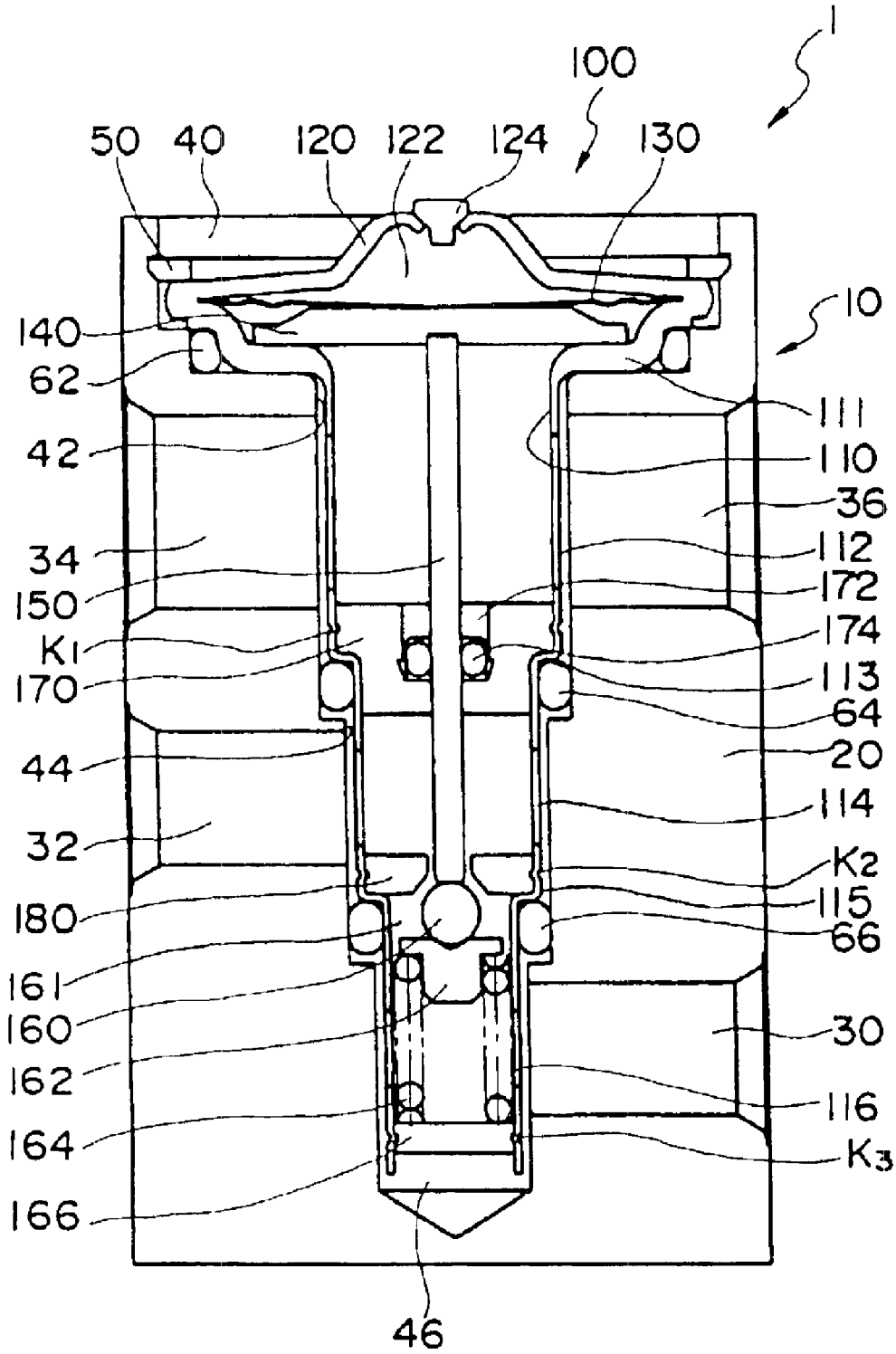
FIG. 1 is a cross-sectional view showing the overall structure of the expansion valve according to the present invention.

FIG. 1 is a cross-sectional view showing one embodiment of the expansion valve including a cassette structure according to the present invention.

An expansion valve denoted as a whole by reference number 1 is equipped with a piping member 10 and a cassette unit 100 formed separately from the piping member 10.

The piping member 10 comprises a body 20 formed of an appropriate material such as aluminum, and the body 20 includes a passage 30 that connects to a pipe through which travels a refrigerant supplied from a compressor not shown, a passage 32 that connects to a pipe through which travels the refrigerant traveling toward an evaporator (not shown), a passage 34 that connects to a pipe through which travels the refrigerant returning from the evaporator, and a passage 36 that connects to a pipe through which travels the refrigerant returning toward the compressor.

Stepped inner wall portions 40, 42, 44, 46 are machined to the center area of the body 20 in the direction orthogonal to the refrigerant passages. The inner wall portion 46 defines the bottom wall of a hole.

The cassette unit 100 inserted to the inner wall portion of the body 20 of the piping member 10 includes a tube member 110 formed for example by deep drawing stainless steel material. The tube member 110 is formed integrally with a flange unit 111 and further includes stepped portions 113 and 115. The end of the tube member 110 opposite from the flange portion 111 is opened.

A stopper member 140 is mounted to the flange portion 111, and a lid member 120 is welded integrally onto the flange portion pinching therein the circumference of a diaphragm 130 that comes into contact with the upper face of the stopper member 140. The lid member 120 and the diaphragm 130 define a gas charge chamber 122, the chamber being filled with a predetermined gas before being sealed with a plug 124. The gas charge chamber 122 and the diaphragm 130 constitute the drive mechanism of the valve.

Through holes 112, 114, and 116 are formed to the tube member 110 through which refrigerant travels. A shaft member 150 comes into contact with the lower surface of the stopper member 140 and penetrates a guide member 170 and an orifice member 180 to come into contact at the other end with a valve means 160 positioned within a valve chamber 161.

The spherical valve means 160 is supported by a support member 162, and the support member 162 is further supported by a fix plate 166 through a spring 164.

The guide member 170 is equipped with a seal member 174 inserted thereto and fixed by a support member 172. The seal member 174 not only guides the shaft member 150, but also seals and prevents refrigerant from leaking between the passage 32 for the refrigerant traveling toward the evaporator and the passage 34 for the refrigerant returning from the evaporator. The guide member 170 is fixed to the tube member 110 through a caulking portion $K_1$. Furthermore, the orifice member 180 and the fix plate 166 are also fixed thereto through caulking portions $K_2$ and $K_3$, respectively.

The cassette unit 100 is inserted to the inner wall portion of the body 20 of the piping member 10 and fixed to position by a stop ring 50. Three sealing members 62, 64 and 66 are fit to the space between the inner wall portion of the body 20 and the cassette member 100, thereby defining a seal between the outer periphery of the cassette unit 100 and the inner wall portion of the body 20 of the piping member 10.

Through such structure, the temperature of the low-pressure refrigerant traveling from the evaporator through passages 34 and 36 toward the compressor is transmitted through the shaft member 150 and the stopper member 140 to the gas charge chamber 122, by which the pressure of the gas filled inside the gas charge chamber 122 changes, and this change in pressure is transmitted through the diaphragm 130 and the shaft member 150 to the valve means 160. Thereby, the valve means 160 is driven to move to a position where the change in vapor pressure, the biasing force of the spring 164, and the refrigerant pressure within passages 34 and 36 are balanced, and the amount of refrigerant traveling from the compressor through the refrigerant passage 30 toward the evaporator is controlled.

Since a space or gap exists between the outer periphery of the tube member 110 of the cassette unit 100 and the inner wall portion of the body 20 of the piping member 10, the passages 30, 32, 34, and 36 formed to the piping member 10 can be designed freely.

Thereby, the piping design and the layout of the air conditioner can be set with greater freedom.

The cassette unit 100 comprises all the functions of an expansion valve by itself.

The piping member 10 exerts its function by the passages formed thereto for connecting the refrigerant pipes to the cassette unit 100 provided with the functions of the expansion valve, so the design of the body or the passages of the piping member 10 can be determined freely.

However, it is important that a secure sealing performance is exerted by the seal structure provided between the cassette unit 100 and the piping member 10.

On the other hand, the tube member 110 of the cassette unit 100 is manufactured by deep drawing stainless steel material, so various structures are employed considering the workability thereof.

Figure 2:
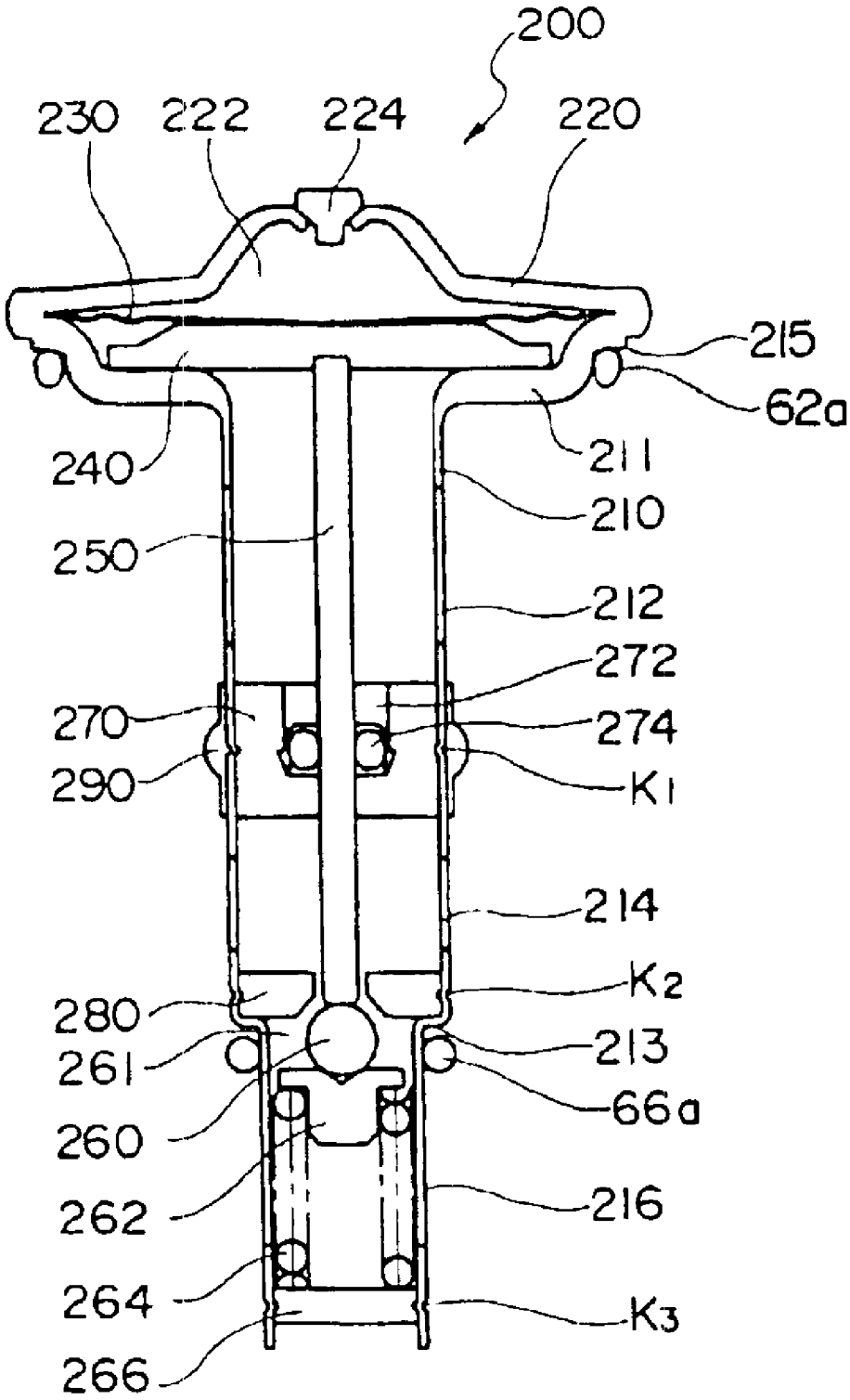
FIG. 2 is a cross-sectional view showing another example of the cassette unit of the expansion valve according to the present invention.

FIG. 2 is a cross-sectional view showing another embodiment of the cassette unit according to the present invention.

In comparison to the structure shown in FIG. 1, the present embodiment includes reduced number of stepped portions. According to FIG. 2, a cassette unit denoted as a whole by reference number 200 comprises a tube member 210 and a flange portion 211 formed integrally therewith, the tube member 210 having a stepped portion 213 and through holes 212, 214, and 216 through which refrigerant travels.

A stopper member 240 is mounted to the flange portion 211, and a lid member 220 is welded integrally to the flange portion pinching therein the circumference of a diaphragm 230 that comes into contact with the upper surface of the stopper member 240. The lid member 220 and the diaphragm 230 define a gas charge chamber 222, the chamber being filled with a predetermined gas before being sealed by a plug 224.

A shaft member 250 comes into contact with the lower surface of the stopper member 240, and the shaft member 250 penetrates a guide member 270 and an orifice member 280 and comes into contact at the other end with a valve means 260 positioned within a valve chamber 261. The orifice member 280 is fixed to the tube member 210 through a caulking portion $K_2$.

The spherical valve means 260 is supported by a support member 262, and the support member 262 is further supported by a fix plate 266 via a spring 264. The fix plate 266 is fixed to the tube member 210 through a caulking portion $K_3$.

A seal member 274 is inserted to the guide member 270 and fixed thereto by a support member 272.

The seal member 274 not only guides the shaft member 250 but also seals any possible leakage between the refrigerant traveling toward the evaporator and the refrigerant returning from the evaporator.

The guide member 270 comprises a cylindrical outer contour and is fixed to the cylindrical portion of the tube member 210 through the caulking portion $K_1$. A rubber bush member 290 is fit to the outer wall of the tube member 210 opposite the guide member 270.

The rubber bush member 290 defines a seal portion when the cassette unit 200 is fit to the piping member 10 shown in FIG. 1. According to such construction of the tube member 210, the flow of refrigerant can be controlled similarly as in FIG. 1, but with a tube member having less stepped portions and thus can be manufactured easier. At this time, a seal member 66*a* is disposed at the stepped portion 213 of the tube member 210, and a seal member 62*a* is disposed at the stepped portion 215 of the flange portion 211.

The above explained embodiment realizes a tube member 210 capable of controlling the flow of refrigerant similarly as the one shown in FIG. 1 but with reduced stepped portions and thus is easier to manufacture.

Figure 3:
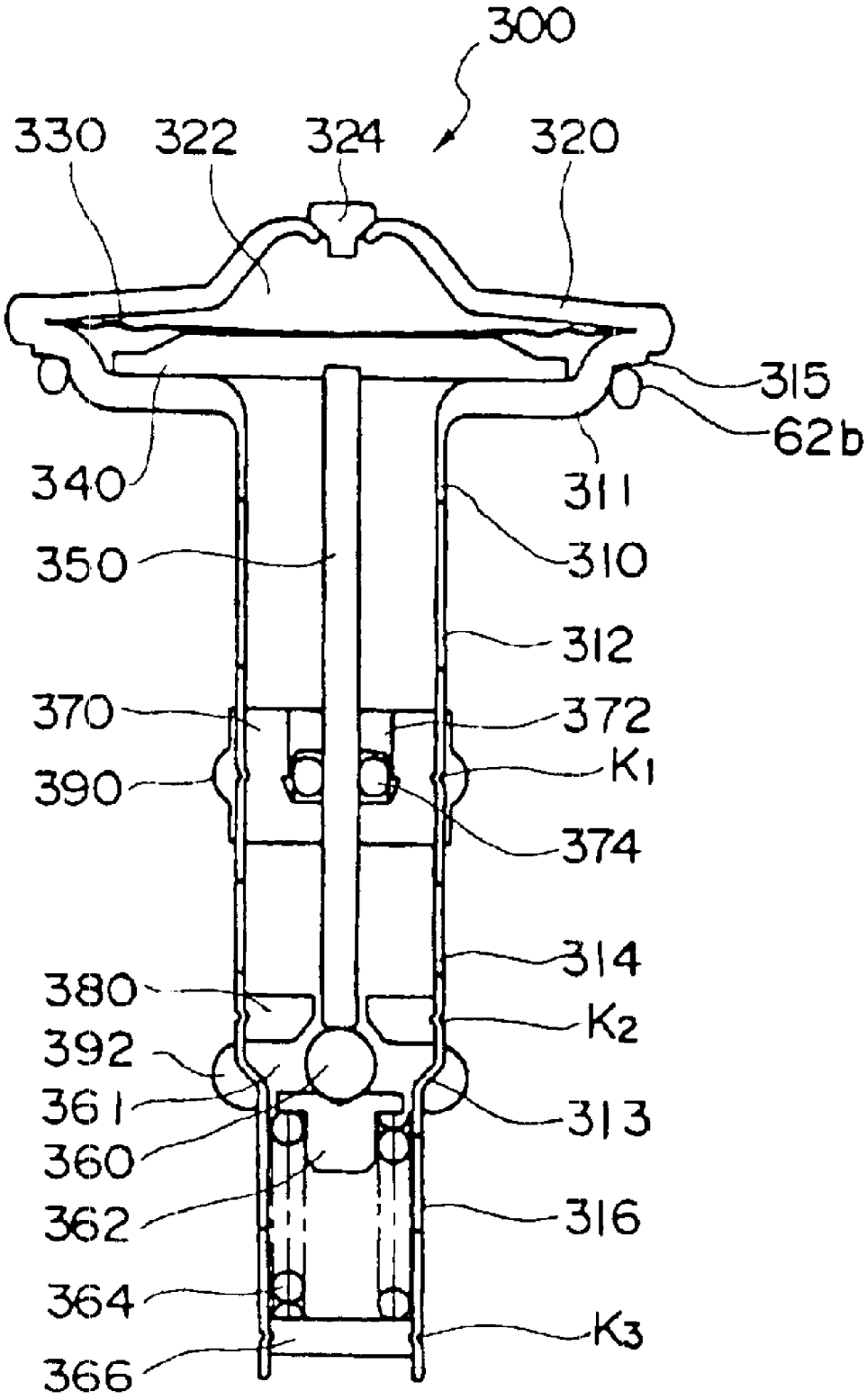
FIG. 3 is a cross-sectional view showing another example of the cassette unit of the expansion valve according to the present invention.

FIG. 3 is a cross-sectional view showing yet another embodiment of the cassette unit according to the present invention.

According also to this embodiment, the flow of refrigerant can be controlled by the same operation as in the embodiment of FIG. 1.

In the drawing, a cassette unit denoted as a whole by reference number 300 comprises a tube member 310 formed integrally with a flange portion 311, the tube member 310 including a stepped portion 313, and through holes 312, 314, and 316 through which refrigerant travels.

A stopper member 340 is mounted on the flange portion 311, and a lid member 320 is welded integrally to the flange portion pinching therein the circumference of a diaphragm 330 that comes into contact with the upper surface of the stopper member 340. The lid member 320 and the diaphragm 330 define a gas charge chamber 322, the chamber being filled with a predetermined gas before being sealed by a plug 324.

A shaft member 350 comes into contact with the lower surface of the stopper member 340, and the shaft member 350 penetrates a guide member 370 and an orifice member 380 and comes into contact at the other end with the valve means 360 disposed within the valve chamber 361. The orifice member 380 is fixed to the tube member 310 through a caulking portion $K_2$.

The spherical valve means 360 is supported by a support member 362, and the support member 362 is supported through a spring 364 by a fix plate 366. The fix plate 366 is fixed to the tube member 310 through a caulking portion $K_3$.

A seal member 374 is inserted to the guide member 370 and fixed thereto by a support member 372.

The seal member 374 not only guides the shaft member 350 but also prevents any possible leak between the refrigerant traveling toward the evaporator and the refrigerant returning from the refrigerant.

The guide member 370 comprises a cylindrical outer contour, and is fixed to the cylindrical wall of the tube member 310 through a caulking portion $K_1$. A rubber bush member 390 is fit to the outer wall of the tube member 310 opposite the guide member 370.

Furthermore, a rubber seal member 392 is baked onto a stepped portion 313 of the tube member 310. A seal member 62*b* is disposed to a stepped portion 315 of the flange portion 311. The rubber bush member 390 and the seal members 392 and 62*b* constitute a seal when the cassette unit 300 is inserted to the piping member 10 shown in FIG. 1.

Figure 4:
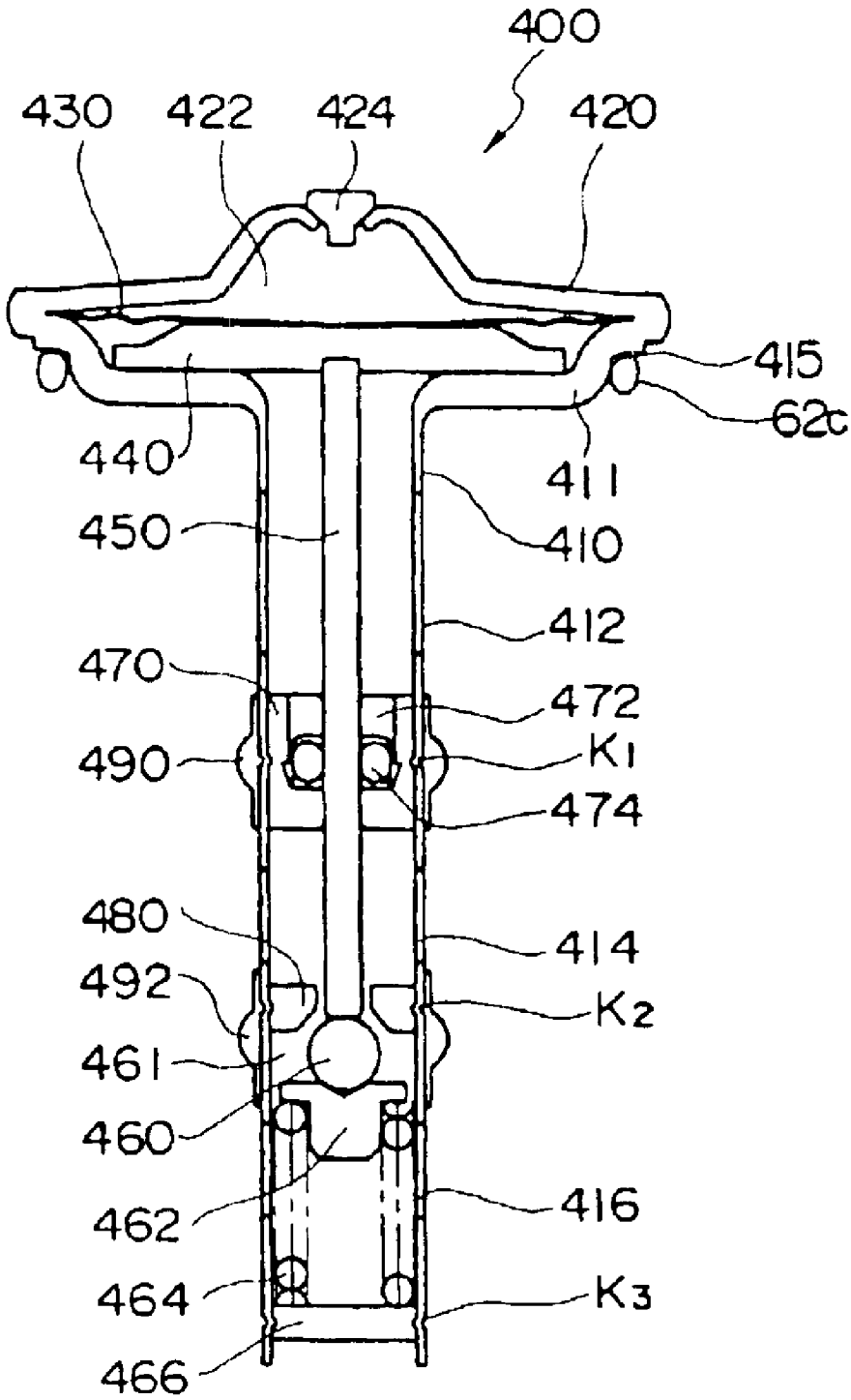
FIG. 4 is a cross-sectional view showing yet another example of the cassette unit of the expansion valve according to the present invention.

FIG. 4 is a cross-sectional view showing yet another embodiment of the cassette unit according to the present invention.

The present embodiment utilizes a tube member that does not include any stepped portion, but can operate similarly as the one shown in FIG. 1.

In the drawing, a cassette unit shown as a whole by reference number 400 comprises a tube member 410 formed integrally with a flange portion 411, the tube member formed to have a substantially straight cylindrical body with through holes 412, 414 and 416 formed thereto through which refrigerant travels.

A stopper member 440 is mounted on the flange portion 411, and a lid member 420 is welded integrally to the flange portion pinching therein the circumference of a diaphragm 430 that comes into contact with the upper surface of the stopper member 440. The lid member 420 and the diaphragm 430 define a gas charge chamber 422 functioning as a temperature sensing chamber, the chamber being filled with a predetermined gas before being sealed with a plug 424.

A shaft member 450 comes into contact with the lower surface of the stopper member 440, and the shaft member 450 penetrates a guide member 470 and an orifice member 480 and comes into contact at the other end with a valve means 460 disposed within a valve chamber 461. The orifice member 480 is fixed to the tube member 410 through a caulking portion $K_2$.

The spherical valve means 460 is supported by a support member 462, and the support member 462 is supported by a fix plate 466 via a spring 464.

A seal member 474 is inserted to the guide member 470 and fixed thereto by a support member 472.

The seal member 474 guides the shaft member 450 and prevents any possible leakage of the refrigerant traveling toward the evaporator and the refrigerant returning from the evaporator.

The guide member 470 comprises a cylindrical outer contour, and is fixed to the cylindrical wall of the tube member 410 through a caulking portion $K_1$. A rubber bush member 490 is fit to the outer wall of the tube member 410 opposite the guide member 470.

Furthermore, a rubber bush member 492 is fit to the wall outside the valve chamber 461. A seal member 62*c* is disposed at a stepped portion 415 of the flange portion 411. The rubber bush members 490, 492 and the seal member 62*c* form a seal when the cassette unit 400 is inserted to the piping member 10 shown in FIG. 1.

The degree of freedom of the design of the expansion valve according to the present invention will now be explained with reference to FIGS. 5–8. In FIGS. 5–8, the components that are identical to those in FIG. 1 are provided with the same reference numbers, and the explanations thereof are omitted.

Figure 5:
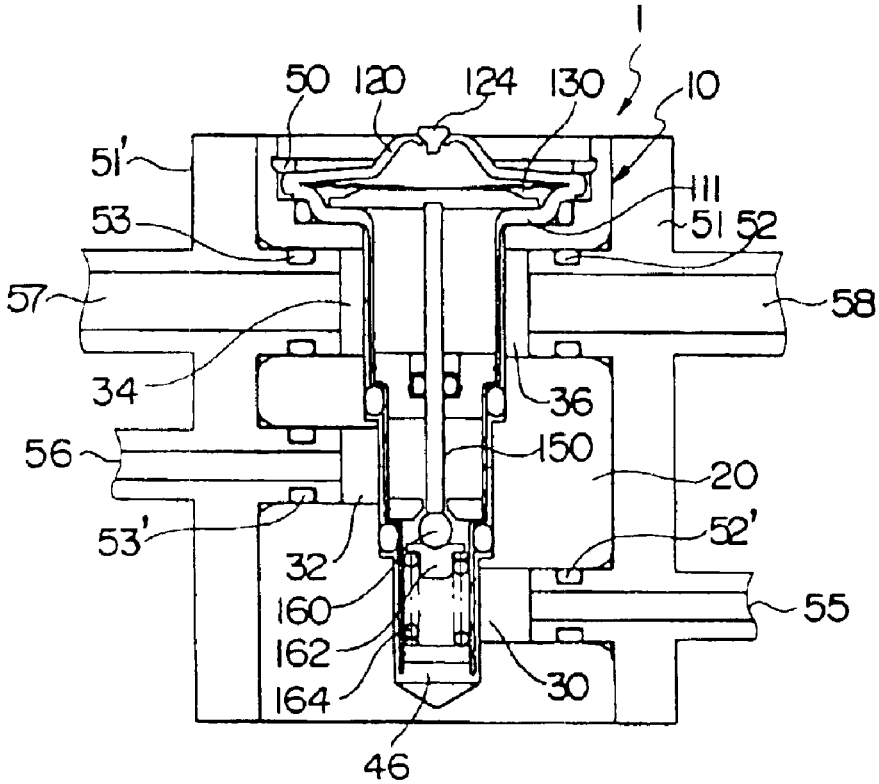
FIG. 5 is a cross-sectional view showing an example of the expansion valve piping according to the present invention.
Figure 6:
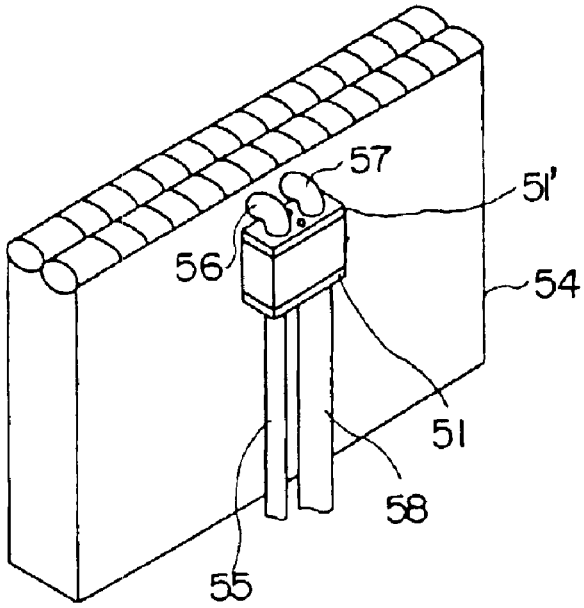
FIG. 6 is a cross-sectional view showing another example of the expansion valve piping according to the present invention.

FIG. 5 is across-sectional view showing an example of flange connection where flanges 51 and 51' are used to connect the refrigerant pipes to the expansion valve 1 upon mounting the expansion valve 1 according to the embodiment shown in FIG. 1 to the evaporator. In the drawing, flanges 51 and 51' are appropriately mounted in an airtight manner on a body 20 of a piping member 10 of the expansion valve 1 using o-rings 52, 52' and o-rings 53, 53'. FIG. 6 shows the expansion valve 1 connected to the evaporator by the flange connection.

FIG. 6 is a drawing showing the outline for connecting the expansion valve 1 of FIG. 1 to an evaporator 54. The refrigerant coming in from a compressor not shown is introduced via a pipe 55 to the refrigerant passage 30, travels through the refrigerant passage 32 and out toward the evaporator 54 via a pipe 56. After traveling through the evaporator 54, the refrigerant exiting the evaporator 54 flows through a pipe 57 into the refrigerant passage 34, travels through the refrigerant passage 36 and exits toward the compressor via a pipe 58. The pipes 55–58 are respectively connected to the flanges 51 and 51' for example by press-fit or insertion. Moreover, the pipes can be formed integrally with the flanges 51, 51'.

Figure 7:
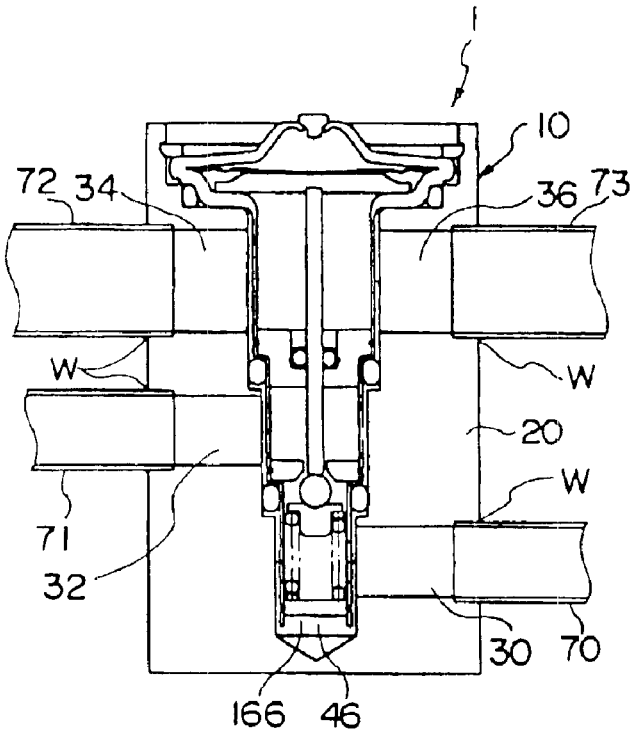
FIG. 7 is a cross-sectional view showing yet another example of the expansion valve piping according to the present invention.
Figure 8:
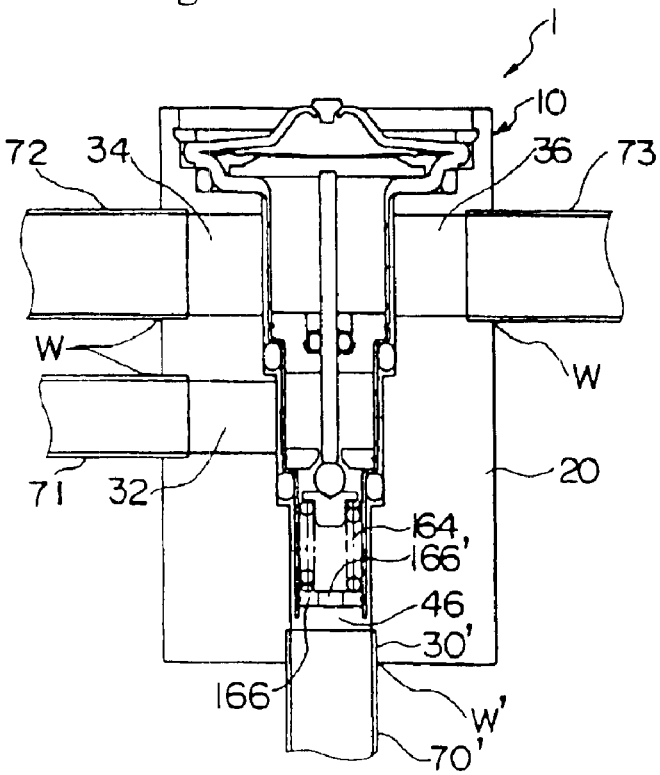
FIG. 8 is a cross-sectional view showing yet another example of the expansion valve piping according to the present invention.

Moreover, FIGS. 7 and 8 are drawings showing two examples of pipe connection, wherein upon connecting the pipes to the expansion valve 1 according to the embodiment shown in FIG. 1, the pipes are directly welded on to the body 20 of the piping member 10. In FIG. 7, pipes 70, 71, 72, and 73 made for example of aluminum are respectively connected to refrigerant passages 30, 32, 34, and 36 formed to the piping member body 20, and the pipes are fixed to the piping member body 20 through weld portions W.

FIG. 8 shows an example where according to the pipe connection of FIG. 7, the pipe 70 is connected to an inner (bottom) wall portion 46. A refrigerant passage 30' is formed to the piping member body 20 through which the refrigerant supplied from a compressor travels, the passage 30' being communicated to the inner bottom wall portion 46. A pipe 70' is welded to the passage 30' via a weld portion W' and thereby fixed to the piping member body 20. Further, FIG. 8 shows the case where a through hole 166' is formed to a plate member 166.

As explained above, the expansion valve according to the present invention comprises a piping member having pipes communicating the various equipments in the air conditioner and the expansion valve inserted thereto, and a cassette unit which is formed separately from the piping member and inserted to the piping member so as to exert the functions of the expansion valve, the expansion valve being manufactured by assembling the piping member and the cassette unit.

The method for connecting the refrigerant pipes or the design of the refrigerant passage formed in the piping member can be selected freely according to the layout of the air conditioner to which the present valve is applied, and thus, the design freedom is improved greatly.

According to the present invention, the structure of the cassette unit is simplified and the overall cost is reduced.

What is claimed is:

1. An expansion valve mounted to an air conditioner for controlling the flow of a refrigerant, the expansion valve comprising;

a piping member including piping member refrigerant passages to which pipes communicated to various equipments of the air conditioner are connected;

a cassette unit inserted to the piping member, said cassette unit comprising a tube member formed integrally with a flange unit as an integral construction and including tube member refrigerant passages with respective ones of the tube member refrigerant passages corresponding to and aligned with respective ones of the piping member refrigerant passages; a guide member having a large diameter portion and a small diameter portion, an orifice member, and a plate member fixed to the inside of the tube member; a valve means equipped inside a valve chamber defined by said orifice member and including a shaft extending through and operative to slide relative to the guide member; the plate member further defining said valve chamber; a spring disposed between the plate member and the valve means for biasing the valve means toward the orifice member; a shaft member for driving the valve means; a lid member welded onto the flange portion; a diaphragm pinched between the lid member and the flange portion and defining a gas charge chamber and a stopper member for transmitting the displacement of the diaphragm to the shaft member;

a ring for fixing to the piping member the lid member of the cassette unit inserted to the piping member; and a seal member disposed between the outer wall of the cassette unit and the inner wall of the piping member, the seal member being retained in a space formed between and defined by a tubular member stepped inner wall surface of the tubular member and a piping member stepped inner wall surface of the piping member disposed in offset confronting relations with one another, the seal member in contact with the tubular member stepped inner wall surface and positioned to surround the small diameter portion of the guide member.

2. An expansion valve according to claim 1, wherein the axis line of the refrigerant passage formed to the piping member is designed to correspond to the layout of the pipes.

3. An expansion valve according to claim 1, further comprising a rubber bush mounted to the exterior of the tube member.

4. An expansion valve mounted to an air conditioner for controlling the flow of a refrigerant, the expansion valve comprising:

a piping member including piping member refrigerant passages to which pipes communicated to various equipments of the air conditioner are connected;

a cassette unit inserted to the piping member, said cassette unit comprising a tube member formed integrally with a flange unit as an integral construction and including tube member refrigerant passages with respective ones of the tube member refrigerant passages corresponding to and aligned with respective ones of the piping member refrigerant passages; a guide member, an orifice member, and a plate member fixed to the inside of the tube member; a valve means equipped inside a valve chamber defined by said orifice member; the plate member further defining said valve chamber; a spring disposed between the plate member and the valve means for biasing the valve means toward the orifice member; a shaft member for driving the valve means; a lid member welded onto the flange portion; a diaphragm pinched between the lid member and the flange portion and defining a gas charge chamber; and a stopper member for transmitting the displacement of the diaphragm to the shaft member;

a ring for fixing to the piping member the lid member of the cassette unit inserted to the piping member; and a seal member disposed between the outer wall of the cassette unit and the inner wall of the piping member, wherein the seal member is a rubber seal member baked onto the exterior of the tube member.

5. An expansion valve mounted to an air conditioner for controlling the flow of a refrigerant, the expansion valve comprising;

a piping member including piping member refrigerant passages to which pipes communicated to various equipments of the air conditioner are connected;

a cassette unit inserted to the piping member, said cassette unit comprising a tube member formed integrally with a flange unit as an integral construction and including tube member refrigerant passages with respective ones of the tube member refrigerant passages corresponding to and aligned with respective ones of the piping member refrigerant passages; a guide member, an orifice member, and a plate member fixed to the inside of the tube member; a valve means equipped inside a valve chamber defined by said orifice member; the plate member further defining said valve chamber; a spring disposed between the plate member and the valve means for biasing the valve means toward the orifice member; a shaft member for driving the valve means; a lid member welded onto the flange portion; a diaphragm pinched between the lid member and the flange portion and defining a gas charge chamber; and a stopper member for transmitting the displacement of the diaphragm to the shaft member;

a ring for fixing to the piping member the lid member of the cassette unit inserted to the piping member; and a seal member disposed between the outer wall of the cassette unit and the inner wall of the piping member, wherein the guide member, the orifice member, and the plate member are fixed to the tube member through crimping.

6. An expansion valve according to claim 4, further comprising a rubber bush mounted to the exterior of the tube member.

7. An expansion valve according to claim 5, further comprising a rubber bush mounted to the exterior of the tube member.

* * * * *